US007898181B2

(12) United States Patent
Soga et al.

(10) Patent No.: US 7,898,181 B2
(45) Date of Patent: Mar. 1, 2011

(54) TRAVELING WAVE TUBE

(75) Inventors: Kazuhito Soga, Sagamihara (JP); Akira Chiba, Sagamihara (JP)

(73) Assignee: Netcomsec Co., Ltd., Tokyo (JP)

( * ) Notice: Subject to any disclaimer, the term of this patent is extended or adjusted under 35 U.S.C. 154(b) by 367 days.

(21) Appl. No.: 12/167,814

(22) Filed: Jul. 3, 2008

(65) Prior Publication Data

US 2009/0009086 A1 Jan. 8, 2009

(30) Foreign Application Priority Data

Jul. 6, 2007 (JP) ..... 2007-178238

(51) Int. Cl.
*H01J 25/34* (2006.01)

(52) U.S. Cl. ..... 315/3.5; 315/39.3

(58) Field of Classification Search ..... 315/3.5, 315/39.3

See application file for complete search history.

(56) References Cited

U.S. PATENT DOCUMENTS

| | | | | | |
|---|---|---|---|---|---|
| 3,300,678 | A | * | 1/1967 | Swensen | 315/3.5 |
| 3,735,188 | A | * | 5/1973 | Anderson et al. | 315/3.5 |
| 4,005,329 | A | * | 1/1977 | Manoly | 315/3.5 |
| 4,158,791 | A | * | 6/1979 | Lien et al. | 315/3.5 |
| 4,358,704 | A | * | 11/1982 | Conquest | 315/3.5 |
| 4,683,400 | A | * | 7/1987 | Seal | 315/3.5 |
| 5,038,076 | A | * | 8/1991 | Smith et al. | 315/3.5 |
| 5,274,304 | A | * | 12/1993 | Nishida | 315/3.5 |
| 5,495,144 | A | * | 2/1996 | Nishida | 315/3.5 |

FOREIGN PATENT DOCUMENTS

| | | | |
|---|---|---|---|
| JP | 5-41175 | A | 2/1993 |
| JP | 2005-339892 | A | 12/2005 |

* cited by examiner

*Primary Examiner* — Thuy Vinh Tran
(74) *Attorney, Agent, or Firm* — Sughrue Mion, PLLC

(57) ABSTRACT

A bottom portion of a metal tape is attached to an end portion of a helix. A coaxial inner conductor for input or output of a high frequency signal is fixed by its end portion being interposed between upright surfaces of the metal tape. The metal tape is joined to the coaxial inner conductor by being laser-welded to opposite side surfaces of the coaxial inner conductor.

7 Claims, 7 Drawing Sheets

TRAVELING WAVE TUBE

This application is based upon and claims the benefit of priority from Japanese patent application No. 2007-178238, filed on Jul. 6, 2007, the disclosure of which is incorporated herein in its entirety by reference.

BACKGROUND OF THE INVENTION

1. Field of the Invention

The present invention relates to a traveling wave tube having a helix which causes a high frequency signal input from the outside and an electron beam to interact with each other.

2. Description of the Related Art

FIG. 1 is a schematic longitudinal sectional view of the construction of a traveling wave tube disclosed in Japanese Patent Laid-Open No. 2005-339892 (hereinafter referred to as patent document 1).

As shown in FIG. 1, traveling wave tube 1 has electron gun 10 which emits an electron beam, high frequency circuit unit 20 which amplifies a high frequency signal (microwave), collector electrodes 30 used to capture the electron beam, anode electrode 40 used to draw out electrons from electron gun 10 and to guide the electron beam emitted from electron gun 10 to high frequency circuit unit 20.

Electron gun 10 has cathode electrode 11 for emitting electrons, heater 12 for supplying thermal energy for causing emission of thermal electrons from cathode electrode 11 and Wehnelt electrode 13 used to focus electrons emitted from cathode electrode 11

High frequency circuit unit 20 has helix 21 which causes an electron beam emitted from electron gun 10 and a high frequency signal (microwave) to interact with each other, input circuit 22 for supplying helix 21 with a high frequency signal input from the outside and output circuit 23 for outputting the high frequency signal output from helix 21 to the outside. A waveguide or a coaxial line for transmitting the high frequency signal is connected to input circuit 22 and output circuit 23. FIG. 1 shows an example of the construction in which waveguide 50 is connected to input circuit 22 and output circuit 23.

Each of input circuit 22 and output circuit 23 has coaxial inner conductor 24 for input or output of the high frequency signal to or from helix 21. The high frequency signal is input to helix 21 via coaxial inner conductor 24 provided in input circuit 22. The high frequency signal output from helix 21 is radiated from coaxial inner conductor 24 provided in output circuit 23 into waveguide 50 connected to output circuit 23.

Helix 21 is supported and fixed in tubular case 26 by (ordinarily three) supporting columns 25 made of a dielectric or the like. Coaxial inner conductor 24 is fixed at a predetermined position on the sealed-end side of waveguide 50 by a ceramic window provided for vacuum-sealing the interior of case 26.

FIGS. 2A and 2B show a connection between a coaxial inner conductor and a helix disclosed in Japanese Patent Laid-Open No. 5-41175 (hereinafter referred to as patent document 2). FIG. 2A is an enlarged longitudinal sectional view showing an essential high frequency circuit unit, and FIG. 2B is a sectional view of the coaxial inner conductor taken along line A-A' in FIG. 2A.

In ordinary cases, a high-melting point metal such as molybdenum or tungsten is used for helix 21 and coaxial inner conductor 24. It is difficult to directly weld helix 21 and coaxial inner conductor 24 made of such a metal. Therefore, as shown in FIG. 2A, helix 21 and coaxial inner conductor 24 are connected by using metal tape 27 which is made of nickel, platinum or an alloy containing nickel and platinum, and which is weldable to helix 21 and coaxial inner conductor 24. One end of metal tape 27 is welded to an end portion of helix 21 in advance, and another end of metal tape 27 is laser-welded to an end portion of coaxial inner conductor 24.

Coaxial inner conductor 24 is columnar in ordinary cases. Therefore, patent document 2 proposes a construction in which the end portion of coaxial inner conductor 24 is chamfered into a flat surface, as shown in FIG. 2B for example, and the flat surfaces of metal tape 27 and coaxial inner conductor 24 are brought into contact with each other to increase the area of contact between metal tape 27 and coaxial inner conductor 24.

FIGS. 3A and 3B are diagrams showing welded portions of metal tape 27 and coaxial inner conductor 24 in the related art shown in FIGS. 2A and 2B.

As described above, helix 21 is supported and fixed in case 26 by supporting columns 25. Therefore, an operation to weld metal tape 27 to coaxial inner conductor 24 is performed from the opening side of case 26 (in direction A in FIG. 3A).

More specifically, metal tape 27 formed into an L-shape is joined to an end portion of helix 21 in advance so that the upright surface of metal tape 27 can be seen from the opening side of case 26. Helix 21 to which metal tape 27 has been joined is supported and fixed in case 26 and laser welding for welding an end portion of metal tape 27 to coaxial inner conductor 24 is thereafter performed from the opening side of case 26, as shown in FIG. 3B.

In laser welding for joining metallic members by using laser beam as a heat source, a portion called a nugget is formed as a result of melting and solidification of a metal is formed in a portion irradiated with laser beam and its surrounding portion. A plurality of solid round marks shown at an end of metal tape 27 in FIGS. 3A and 3B represent welded portions (nuggets) of metal tape 27 and coaxial inner conductor 24 thus formed.

In the high frequency circuit unit in the related art, as shown in FIGS. 3A and 3B, the welded portion is limited to the end of metal tape 27 as the boundary between metal tape 27 and coaxial inner conductor 24 which can be visually checked from the opening side of case 26. Therefore, the high frequency circuit unit in the related art has a problem in that the area of contact between metal tape 27 and coaxial inner conductor is reduced.

If the area of contact between the metal tape and the coaxial inner conductor is reduced, the thermal conductivity at the portions of the metal tape and at the coaxial inner conductor that are in contact with each other becomes lower and, correspondingly, the heat dissipation capacity with respect to heat generated in helix 21 becomes lower to allow the temperature of helix 21 to rise. With this change, there is a risk of a deterioration in electrical characteristics of the traveling wave tube and a reduction in stability of the operation of the traveling wave tube. In the case of a high-output traveling wave tube having an increased amount of heat generation in helix 21 in particular, there is a possibility of a breakage in the traveling wave tube, such as melting and cutting of metal tape 27 at the worst.

According to the above-described patent document 2, the end portion of coaxial inner conductor 24 is chamfered into a flat surface and the flat surfaces of metal tape 27 and coaxial inner conductor 24 are brought into contact with each other to increase the area of contact between metal tape 27 and coaxial inner conductor 24. Even in such a construction, the welded portion is limited to the end of metal tape 27 as the boundary between metal tape 27 and coaxial inner conductor 24 which can be visually checked from the opening side of case 26. In such a case, since effective contact between metal tape 27 and coaxial inner conductor 24 is not ensured at any position other than the position of the welded position, there is a possibility of failure to sufficiently increase the contact area even when the construction disclosed in patent document 2 is used.

SUMMARY OF THE INVENTION

An object of the present invention is to provide a traveling wave tube capable of limiting a reduction in heat dissipation capacity with respect to heat generated in a helix by limiting a reduction in thermal conductivity at a position at which a metal tape and a coaxial inner conductor are in contact with each other.

To achieve the above-described object, according to the present invention, there is provided a traveling wave tube including a helix which causes a high frequency signal input from the outside and an electron beam to interact with each other, a U-shaped metal tape having its bottom portion attached to an end portion of the helix, a coaxial inner conductor for input or output of the high frequency signal to or from the helix, the coaxial inner conductor being fixed in such a position that its end portion is interposed between upright surfaces of the metal tape.

The above and other objects, features, and advantages of the present invention will become apparent from the following description with reference to the accompanying drawings, which illustrate examples of the present invention.

DETAILED DESCRIPTION OF THE PREFERRED EMBODIMENTS

The present invention will be described with reference to the accompanying drawings.

First Exemplary Embodiment

Figure 1:
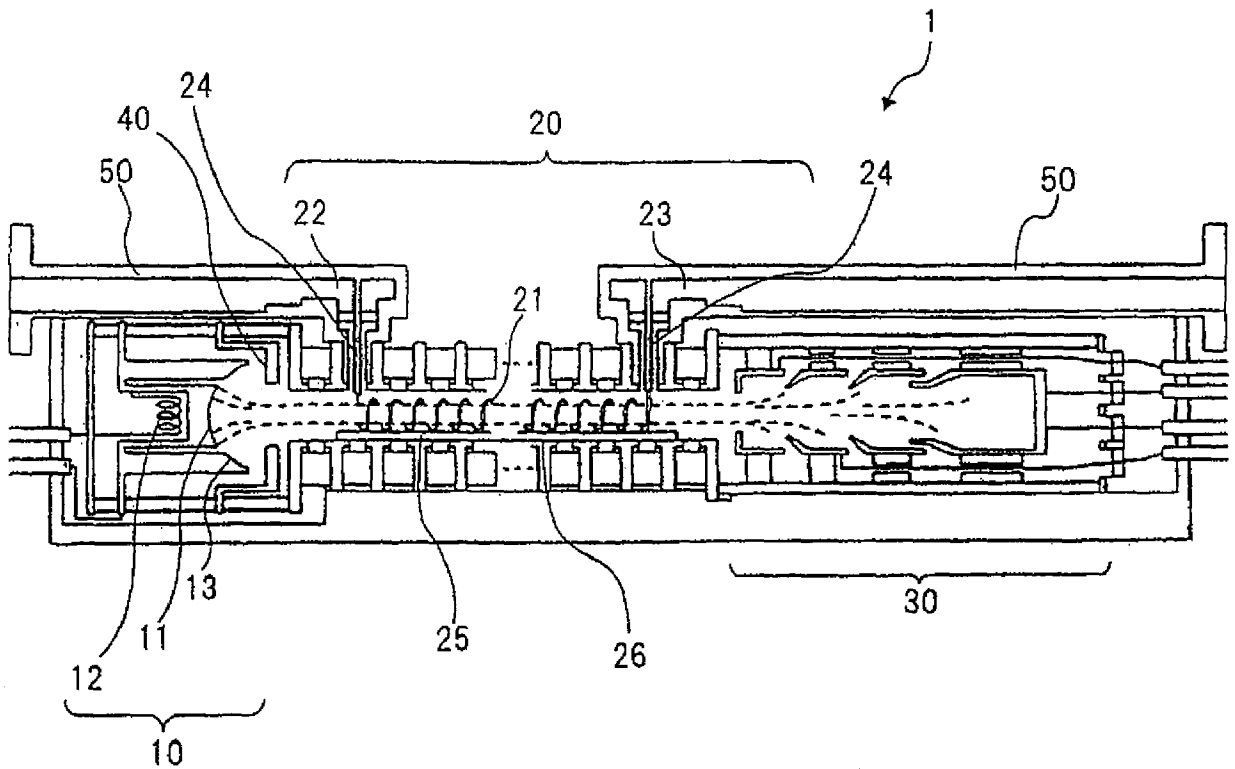
FIG. 1 RELATED ART
FIG. 1 is a schematic longitudinal sectional view of a traveling wave tube disclosed in patent document 1.
Figure 2A:
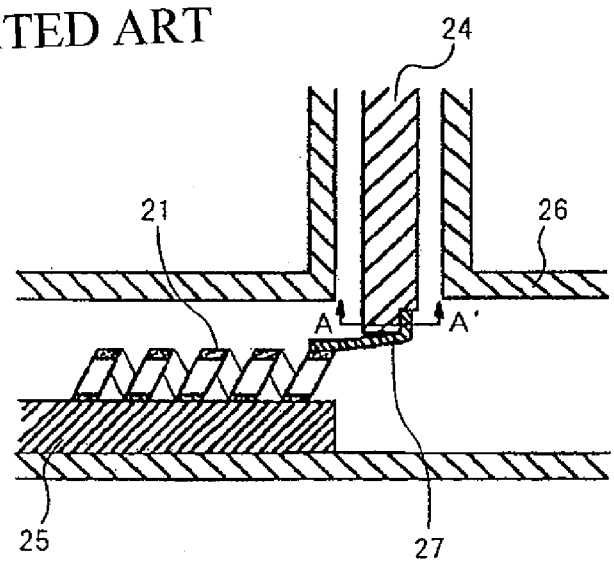
FIG. 2A RELATED ART
FIG. 2A is a longitudinal sectional view showing a connection between a coaxial inner conductor and a helix disclosed in patent document 2.
Figure 2B:
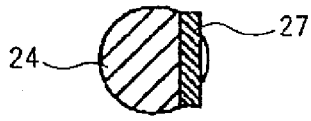
FIG. 2B RELATED ART
FIG. 2B is a sectional view of the coaxial inner conductor taken along line A-A' in FIG. 2A.
Figure 3A:
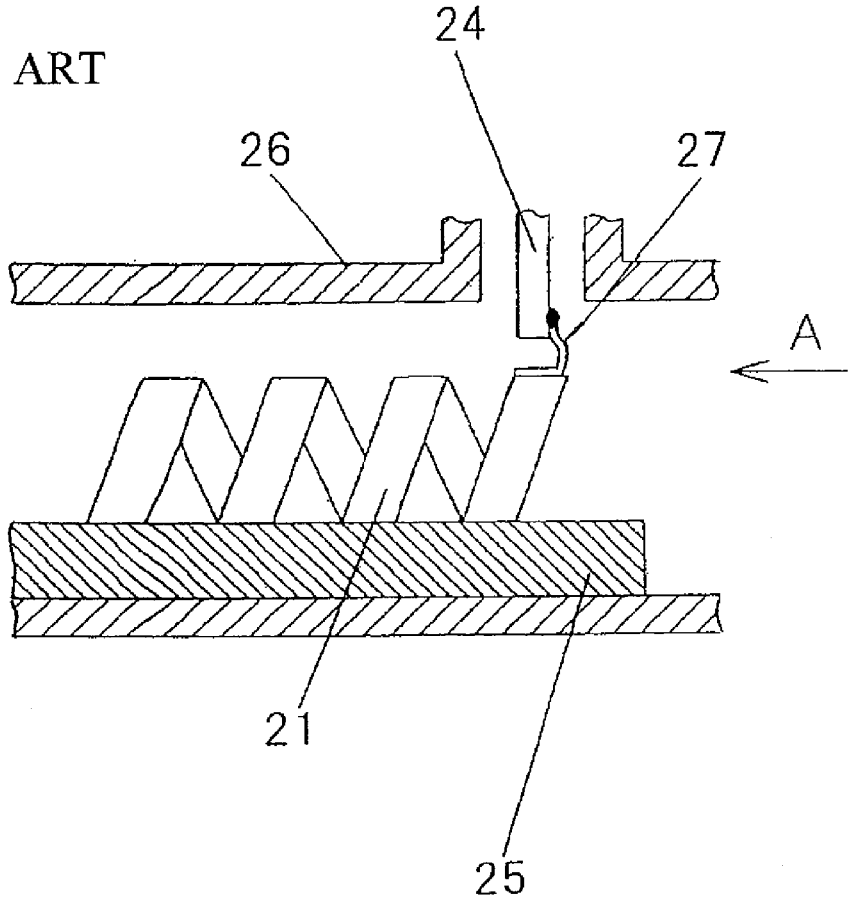
FIG. 3A RELATED ART
FIG. 3A is a longitudinal sectional view showing a connection between the coaxial inner conductor and the helix in the related art.
Figure 3B:
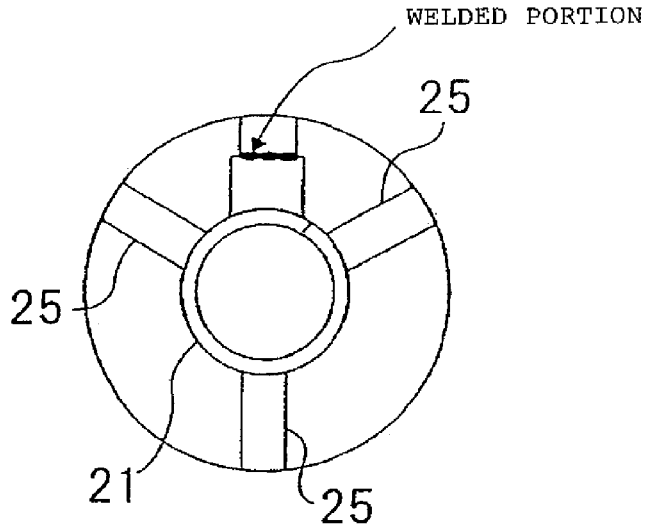
FIG. 3B RELATED ART
FIG. 3B is a side view of a high frequency circuit unit seen in direction A in FIG. 3A.
Figure 4A:
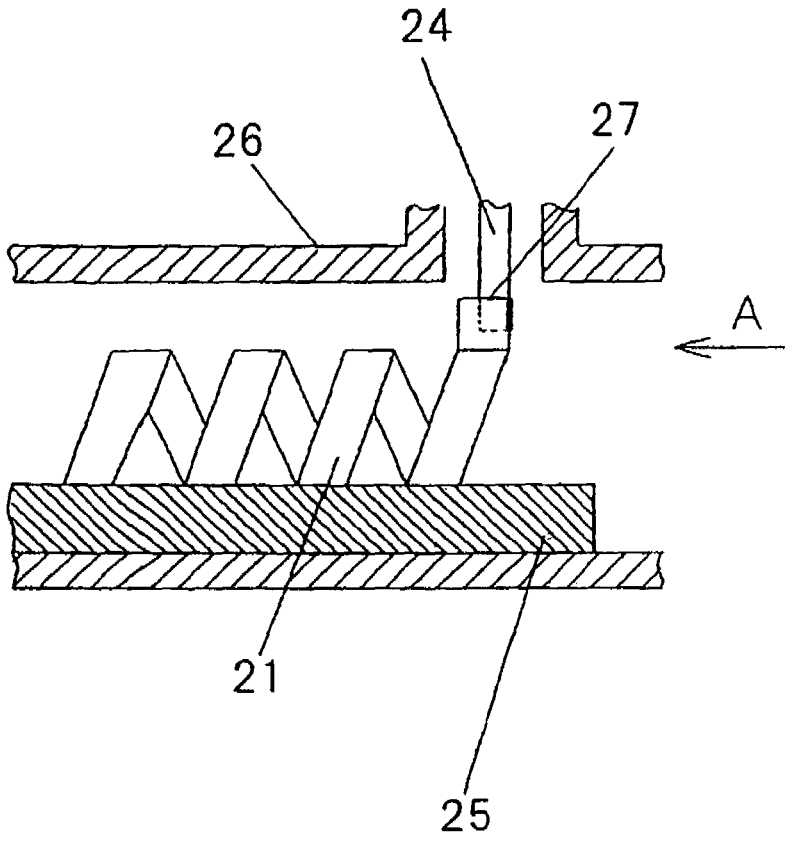
FIG. 4A is a longitudinal sectional view showing a connection between a coaxial inner conductor and a helix in a first exemplary embodiment of the present invention.
Figure 4B:
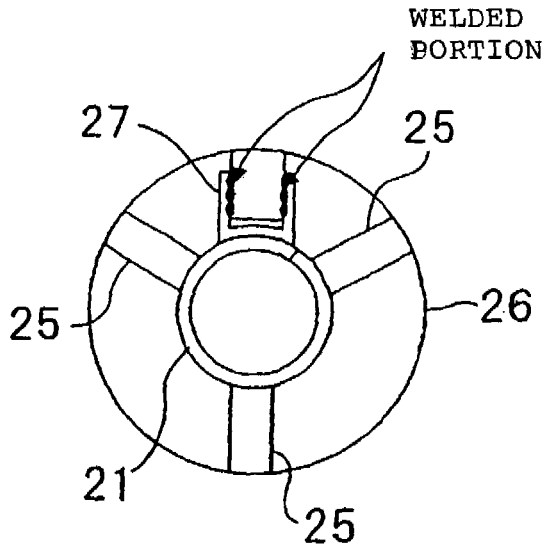
FIG. 4B is a side view of a high frequency circuit unit seen in direction A in FIG. 4A.

FIGS. 4A and 4B are diagrams showing a connection between a coaxial inner conductor and a helix in a first exemplary embodiment of the present invention. FIG. 4A is an enlarged longitudinal sectional view of an essential portion of a high frequency circuit unit, and FIG. 4B is a side view of the high frequency circuit unit seen in direction A in FIG. 4A.

In the high frequency circuit unit in the first exemplary embodiment, as shown in FIGS. 4A and 4B, metal tape 27 is formed into a U-shape; a bottom portion of U-shaped metal tape 27 is attached to an end portion of helix 21; and coaxial inner conductor 24 inserted in case 26 from one side of the same is fixed so that its end portion is interposed between two upright surfaces of metal tape 27. Metal tape 27 is formed by being bent at two positions so that the end portion of coaxial inner conductor 24 can be interposed between its bent portions.

Metal tape 27 is joined to the end portion of helix 21 while being oriented so that its U-shape is seen in direction A in FIG. 4A, i.e., from the opening side of case 26.

In the high frequency circuit unit in the first exemplary embodiment, metal tape 27 is laser-welded to two side surfaces of coaxial inner conductor 24, as shown in FIG. 4B, thereby joining coaxial inner conductor 24 and metal tape 27 to each other. In this welding, metal tape 27 is welded to coaxial inner conductor 24 at those portions of metal tape 27 on which the welding operation can be performed in direction A shown in FIG. 4A, i.e., metal tape 27's two side end portions closest to the opening of cylindrical case 26, in the two upright surfaces of metal tape 27 between which coaxial inner conductor 24, is interposed.

As a method for laser welding, a method of performing point-joining by irradiating a laser beam, for example, in pulse form, melting metallic members by thermal energy of the laser beam and solidifying the molten material is known. In the first exemplary embodiment, welding is repeated a certain number of times while moving the laser beam irradiation center along the boundaries between the side end portions of metal tape 27 and coaxial inner conductor 24, thereby joining metal tape 27 to coaxial inner conductor 24. A plurality of solid round marks shown at the side end portions of metal tape 27 in FIGS. 4A and 4B represent welded portions (nuggets) of metal tape 27 and coaxial inner conductor 24.

In the high frequency circuit unit in the first exemplary embodiment, metal tape 27 and coaxial inner conductor 24 can have increased welded portions in comparison with those in the high frequency circuit unit in the related art shown in FIGS. 2A, 2B, 3A, and 3B. As a result, the area of contact between coaxial inner conductor 24 and metal tape 27 is increased. Also, since metal tape 27 is joined to the opposite side surfaces of coaxial inner conductor 24, stronger adhesion can be maintained between coaxial inner conductor 24 and metal tape 27 in comparison with the high frequency circuit unit in the related art shown in FIGS. 2A, 2B, 3A, and 3B.

In the high frequency circuit unit in the first exemplary embodiment, therefore, the thermal conductivity at the portions of the metal tape and the coaxial inner conductor that are in contact with each other is increased in comparison with the high frequency circuit unit in the related art to limit a reduction in heat dissipation capacity with respect to heat generated in helix 21. The increase in temperature of helix 21 is thereby limited to prevent a deterioration in electrical characteristics of traveling wave tube 1 and a reduction in stability of the operation of traveling wave tube 1. The high frequency circuit unit in the present exemplary embodiment is particularly advantageous when applied to a high power output traveling wave tube having an increased amount of heat generation in helix 21.

Second Exemplary Embodiment

Figure 5A:
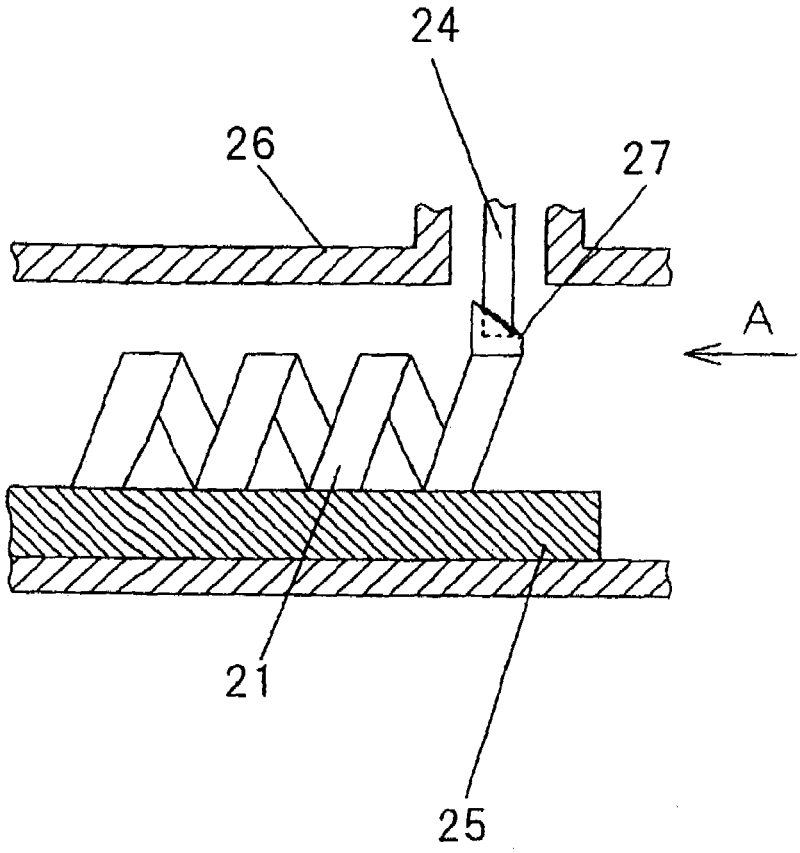
FIG. 5A is a longitudinal sectional view showing a connection between a coaxial inner conductor and a helix in a second exemplary embodiment of the present invention.
Figure 5B:
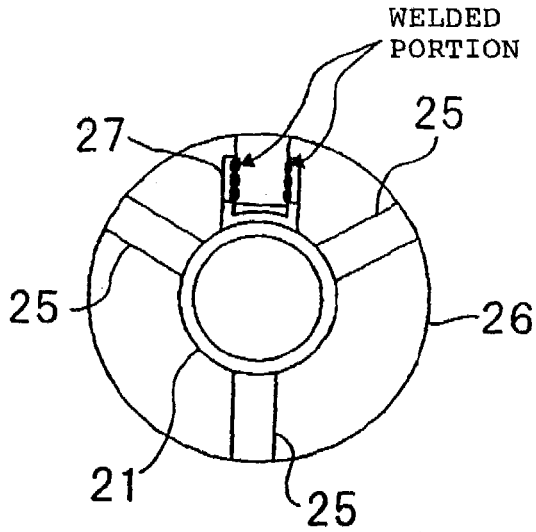
FIG. 5B is a side view of a high frequency circuit unit seen in direction A in FIG. 5A.

FIGS. 5A and 5B are diagrams showing a connection between a coaxial inner conductor and a helix in a second exemplary embodiment of the present invention. FIG. 5A is an enlarged longitudinal sectional view of an essential portion of a high frequency circuit unit, and FIG. 5B is a side view of the high frequency circuit unit seen in direction A in FIG. 4A.

The high frequency circuit unit in the second exemplary embodiment is constructed in the same manner as the high frequency circuit unit in the first exemplary embodiment. That is, metal tape 27 is formed into a U-shape in advance; a bottom portion of U-shaped metal tape 27 is attached to an end portion of helix 21; and coaxial inner conductor 24 inserted in case 26 from one side of the same is fixed so that its end portion is interposed between two upright surfaces of metal tape 27.

Metal tape 27 is joined to the end portion of helix 21 while being oriented so that its U-shape is seen in direction A in FIG. 5A, i.e., from the opening side of case 26. Metal tape 27 is formed by being bent at two positions so that the end portion of coaxial inner conductor 24 can be interposed between its bent portions.

In the high frequency circuit unit in the second exemplary embodiment, top portions of metal tape 27 formed into the U-shape are tapered, as shown in FIG. 5A, and the tapered portions are laser-welded to coaxial inner conductor 24, thereby joining metal tape 27 to coaxial inner conductor 24.

As a method for laser welding, a method of performing point-joining by irradiating a laser beam, for example, in pulse form, melting metallic members by thermal energy of the laser beam and solidifying the molten material can be considered, as in the first exemplary embodiment.

In the second exemplary embodiment, welding is repeated a certain number of times while moving the laser beam irradiation center along the boundaries between the tapered portions of metal tape 27 and coaxial inner conductor 24, thereby joining metal tape 27 to coaxial inner conductor 24. A plurality of solid round marks shown at the side end portions of metal tape 27 in FIGS. 5A and 5B represent welded portions (nuggets) of metal tape 27 and coaxial inner conductor 24.

The tapered top portions are formed so that a front end portion as seen in direction A has the lowest height and a portion remoter from the front end portion has a higher height, to allow welding from direction A shown in FIG. 5A, that is, the height of the upright surfaces forming the U-shape is minimized at the position closest to the opening of case 26 and is maximized at the position remotest from the opening.

In the high frequency circuit unit in the second exemplary embodiment, the tapered portions of metal tape 27 are welded to coaxial inner conductor 24 to enable the welded portions, after the welding operation, to be visually checked in an oblique direction, thus facilitating determination as to whether or not the portions to be welded are welded with reliability in comparison with the first embodiment in which the welded portions after the welding operation, are visually checked in a flat plane.

Thus, in the high frequency circuit unit in the second exemplary embodiment, an improvement in reliability of the operation to weld metal tape 27 to coaxial inner conductor 24 is achieved as well as the same advantages as those of the first exemplary embodiment. Further, thermal conductivity at the portions of metal tape 27 and coaxial inner conductor 24 that are in contact with each other is increased in comparison with the first exemplary embodiment to limit a reduction in heat dissipation capacity with respect to heat generated in helix 21. The increase in temperature of helix 21 is thereby limited to prevent a deterioration in electrical characteristics of traveling wave tube 1 and a reduction in stability of the operation of traveling wave tube 1. The high frequency circuit unit in the present exemplary embodiment is particularly advantageous when applied to a high power-output traveling wave tube having an increased amount of heat generation in helix 21.

Figure 6:
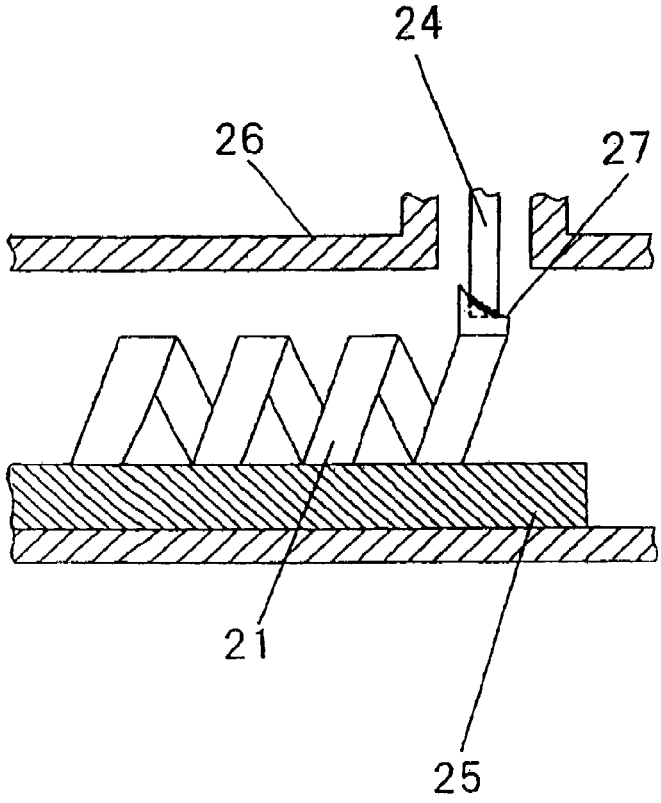
FIG. 6 is an enlarged sectional view of an essential portion of the high frequency circuit unit, showing another example of the shape of top portions of the metal tape shown in FIG. 5A.
Figure 7:
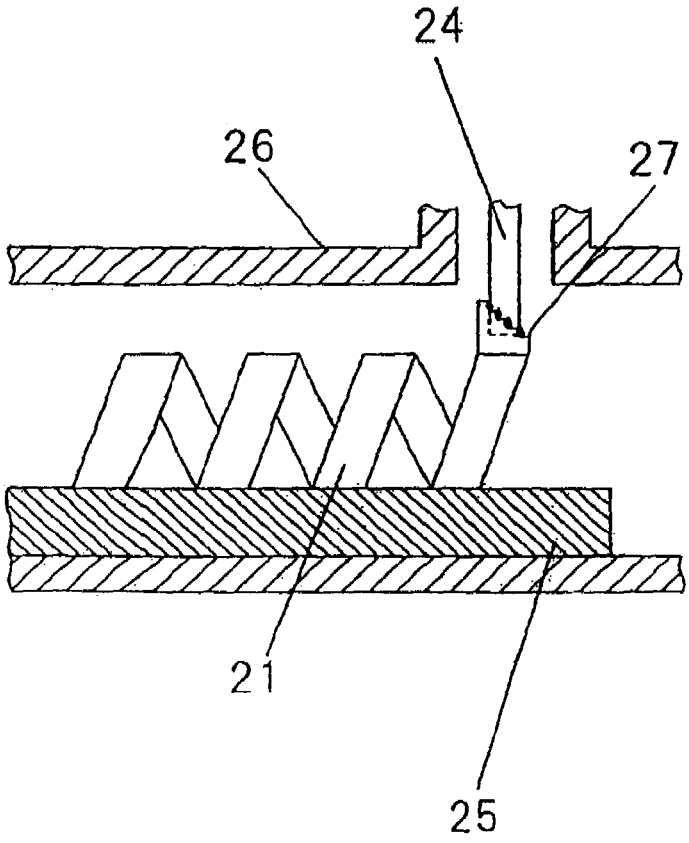
FIG. 7 is an enlarged sectional view of an essential portion of the high frequency circuit unit, showing still another example of the shape of top portions of the metal tape shown in FIG. 5A.

While an example, in which the top portions of metal tape 27 that are formed into a U-shape are tapered, is illustrated in FIGS. 5A and 5B, the shape of the top portions of metal tape 27 is not limited to the U-shape. The top portions of metal tape 27 may have any other shape provided that the height of the upright surfaces forming the U-shape is minimized at the position closest to the opening of case 26 and provided that the height of the upright surfaces forming the U-shape is maximized at the position remotest from the opening. For example, the same advantages as those of the present embodiment can also be obtained in a case where the top portions of metal tape 27 have an inverse circular-arc shape such as shown in FIG. 6. Also, the same advantages as those of the first exemplary embodiment can be obtained in a case where the top portions of metal tape 27 are stepped as shown in FIG. 7, although no improvement in reliability of the welding operation can be expected.

While the invention has been particularly shown and described with reference to exemplary embodiments thereof, the invention is not limited to these embodiments. It will be understood by those ordinarily skilled in the art that various changes in form and details may be made therein without departing from the spirit and scope of the present invention as defined by the claims.

What is claimed is:

1. A traveling wave tube comprising:

a helix;

a U-shaped metal tape having its bottom portion attached to an end portion of said helix;

a coaxial inner conductor for input or output of a high frequency signal to or from said helix, said coaxial inner conductor being fixed in such a position that its end portion is interposed between upright surfaces of said metal tape.

2. The traveling wave tube according to claim 1, further comprising a tubular case in which the helix is supported and fixed, wherein said metal tape is joined to the end portion of said helix while being oriented so that its U-shape can be seen from an opening of the case.

3. The traveling wave tube according to claim 2, wherein said metal tape is welded to the coaxial inner conductor at said metal tape's two side end portions closest to the opening of case in the two upright surfaces of said metal tape between which said coaxial inner conductor is interposed.

4. The traveling wave tube according to claim 2, wherein top portions of said metal tape are formed so that the height of the upright surfaces is minimized at the position closest to the opening of the case and is maximized at the position remotest from the opening, and said metal tape is welded to said coaxial inner conductor at the top portion.

5. The traveling wave tube according to claim 4, wherein the top portions of said metal tape are tapered.

6. The traveling wave tube according to claim 4, wherein the top portions of said metal tape have an inverse circular-arc shape.

7. The traveling wave tube according to claim 4, wherein the top portions of said metal tape are stepped.

* * * * *